US011305166B2

(12) United States Patent
Hunt et al.

(10) Patent No.: US 11,305,166 B2
(45) Date of Patent: Apr. 19, 2022

(54) TURF BASE

(71) Applicant: Wilson Hunt International, Inc., Wheeling, IL (US)

(72) Inventors: Ryan Hunt, Wheeling, IL (US); Matthew Klein, Wheeling, IL (US)

(73) Assignee: Wilson Hunt International, Ltd., Wheeling, IL (US)

( * ) Notice: Subject to any disclaimer, the term of this patent is extended or adjusted under 35 U.S.C. 154(b) by 0 days.

(21) Appl. No.: 16/598,794

(22) Filed: Oct. 10, 2019

(65) Prior Publication Data

US 2020/0114237 A1 Apr. 16, 2020

Related U.S. Application Data

(60) Provisional application No. 62/743,712, filed on Oct. 10, 2018.

(51) Int. Cl.

| | |
|---|---|
| ***A63B 71/00*** | (2006.01) |
| ***A63B 69/00*** | (2006.01) |
| ***A63B 71/02*** | (2006.01) |

(52) U.S. Cl.

CPC ..... *A63B 69/0013* (2013.01); *A63B 71/023* (2013.01); *A63B 2071/024* (2013.01)

(58) Field of Classification Search

CPC ..... A63B 69/0013; A63B 71/023; A63B 2071/024

USPC ..... 473/497–501, 452, 422

See application file for complete search history.

(56) References Cited

U.S. PATENT DOCUMENTS

| | | | | | |
|---|---|---|---|---|---|
| 239,080 | A * | 3/1881 | Baker | E04H 12/2269 | 52/298 |
| 357,675 | A * | 2/1887 | Keating | A63B 69/0013 | 473/499 |
| 3,862,756 | A * | 1/1975 | Selliken | A63B 69/0013 | 473/501 |
| 4,062,140 | A * | 12/1977 | Meyer | G03B 21/64 | 40/706 |
| 4,266,768 | A * | 5/1981 | Hall | A63B 69/0013 | 473/501 |
| 4,398,715 | A * | 8/1983 | Hall | A63B 69/0013 | 473/501 |
| 4,529,199 | A * | 7/1985 | Fatool | A63B 69/0013 | 473/501 |
| 4,531,733 | A * | 7/1985 | Hall | E04H 12/2269 | 473/501 |
| 4,542,901 | A * | 9/1985 | Fatool | A63B 69/0013 | 473/501 |
| 4,976,430 | A * | 12/1990 | Brandon | A63B 69/0013 | 473/501 |
| 4,979,740 | A * | 12/1990 | Hall | A63B 69/0013 | 473/501 |
| 5,003,735 | A * | 4/1991 | Bates | E04B 5/48 | 116/209 |

(Continued)

*Primary Examiner* — Mitra Aryanpour

(74) *Attorney, Agent, or Firm* — Boyle Fredrickson S.C.

(57) ABSTRACT

A base or similar structure utilized in playing a sport is provided including a top base structure including a number of bores formed therein and an insert including an upper surface having a number of studs thereon engageable with the bores, and a lower surface including a number of posts thereon. The posts extend outwardly from the insert to securely engage the ground against horizontal or lateral forces exerted on the base.

8 Claims, 3 Drawing Sheets

(56) References Cited

U.S. PATENT DOCUMENTS

| | | | | | |
|---|---|---|---|---|---|
| 5,415,394 | A * | 5/1995 | Hall | A63B 69/0013 | 473/501 |
| 5,564,695 | A * | 10/1996 | Christensen | A63B 69/0013 | 473/501 |
| 5,590,874 | A * | 1/1997 | Hall | E01F 9/635 | 473/501 |
| 6,077,175 | A * | 6/2000 | Fearnow | A63B 69/0013 | 473/468 |
| 7,874,943 | B1 * | 1/2011 | Chen | A63B 69/0013 | 473/501 |
| 8,070,631 | B2 * | 12/2011 | Nimmons | A63B 69/0013 | 473/499 |
| 8,337,340 | B2 * | 12/2012 | Clark | A63B 69/0013 | 473/497 |
| 2002/0142868 | A1 * | 10/2002 | Nimmons | A63B 69/0013 | 473/499 |
| 2009/0146395 | A1 * | 6/2009 | Heil | A63C 9/003 | 280/601 |
| 2018/0154228 | A1 * | 6/2018 | Louwrens | A63B 71/023 | 473/278 |
| 2019/0184257 | A1 * | 6/2019 | Hubbs | A63B 69/0013 | 473/501 |
| 2020/0114237 | A1 * | 4/2020 | Hunt | A63B 71/023 | 473/501 |

* cited by examiner

TURF BASE

CROSS-REFERENCE TO RELATED APPLICATIONS

This application claims priority from U.S. Provisional Patent Application Ser. No. 62/743,712, filed on Oct. 10, 2018, the entirety of which is expressly incorporated by reference for all purposes.

FIELD OF THE DISCLOSURE

The present disclosure relates generally to sports equipment, and more specifically to a base construction for use in playing baseball or softball.

BACKGROUND OF THE DISCLOSURE

In playing sports involving bases and similar structures, such as baseball and softball, one important aspect of the game is the ability of the bases to be properly installed on the surface on which the sport is played. The bases or similar structures must be securely engaged with the surface on which they are placed, but also must be able to yield and/or be displaced when a sufficient force is applied to them to minimize potential injuries to the players.

In the prior art, many different structures have been employed to attempt to achieve the proper combination of stability and safety. Most base constructions include a support structure that is positioned in a fixed location within the ground and a base structure attached in a displaceable manner to the support structure via a suitable attachment mechanism or structure to position the base structure over the ground. The support structure holds the base structure where desired until the base structure is contacted with a force that is sufficient to disengage the attachment structure and separate the base structure from the fixed support structure.

One significant issue with these prior art bases is that the support structure is designed to be fixed within the ground at the location where the base is to be positioned. As such, the support structure is designed and constructed to be semi-permanently positioned at the location for the base. This construction is not suitable for use in many situations where it is desirable to have a base that is securely attached to the ground but in a manner that enables the base and accompanying support structure to be readily removed and reused on different ground surfaces.

Therefore, it is desirable to develop an improved base structure that can address these issues with the prior art.

SUMMARY OF THE DISCLOSURE

According to one aspect of an exemplary embodiment of the invention, a base or other similar device is formed with a top structure and an insert. The insert includes a number of ground-engaging posts extending outwardly from one side of the insert and a number of base-engaging studs extending outwardly from the insert opposite the posts. In exemplary embodiments, the posts each include a tapered shape that enables the posts to penetrate and engage a natural or synthetic ground surface on which the insert is positioned. Further, the posts enable the insert to be readily disengaged and removed from the ground when desired.

The studs extending outwardly from the insert are positioned generally vertically with respect to the ground when the posts on the insert are engaged with the ground. In this position the studs can be readily engaged within corresponding and aligned blind bores in the top structure. The studs retain the top structure on the insert when in use.

According to another exemplary embodiment of the disclosure, a base is provided including a top base structure including a number of bores formed therein and an insert including an upper surface having a number of studs thereon engageable with the bores, and a lower surface including a number of posts thereon. The posts extend outwardly from the insert to securely engage the ground against horizontal or lateral forces exerted on the insert, but enable the insert to be readily lifted vertically off of the ground engaged by the posts. The studs on the insert are inserted within the bores on the top base structure in a manner that enables the top base structure to be held in the insert.

These and other aspects, features and advantages of the invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE DRAWINGS

Before the present apparatuses and methods are described, it is understood that this invention is not limited to the particular embodiments and methodology, as these may vary. It is also to be understood that the terminology used herein is for the purpose of describing particular exemplary embodiments only, and is not intended to limit the scope of the present invention which will be limited only by the appended claims.

Figure 1:
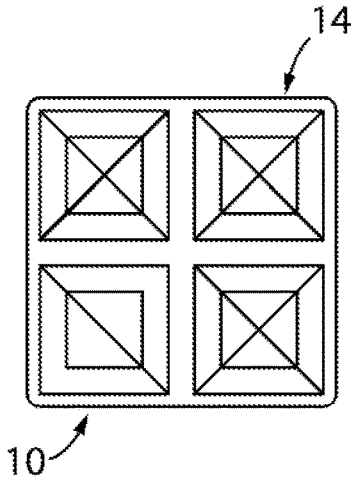
FIG. 1 is front plan view of a base constructed according to an exemplary embodiment the invention.
Figure 2:
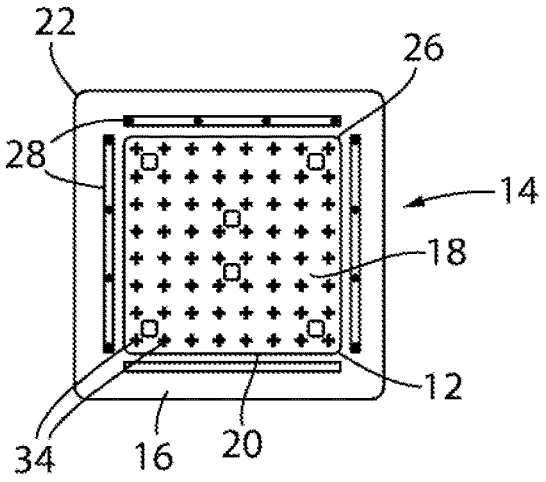
FIG. 2 is a bottom plan view of the base of FIG. 1.
Figure 4:
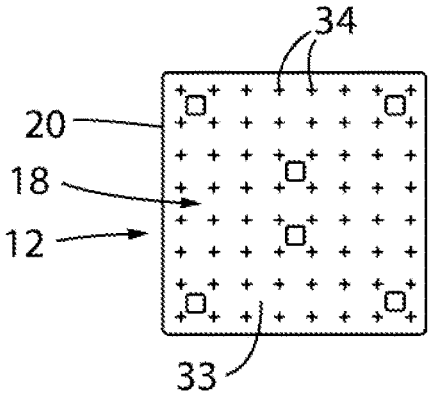
FIG. 4 is a bottom plan view of an insert of the base of FIG. 1 according to an exemplary embodiment the invention.
Figure 5:
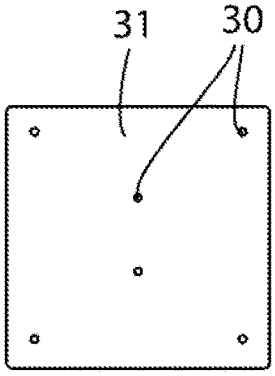
FIG. 5 is a top plan view of the insert of FIG. 4.
Figure 3:
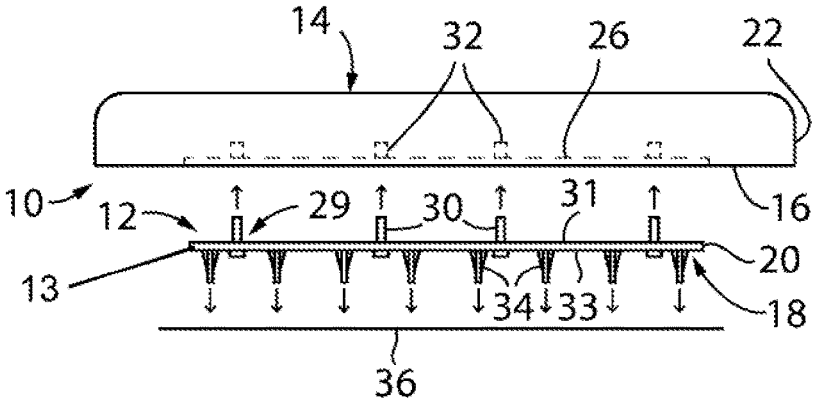
FIG. 3 is an exploded side elevational view of the base of FIG. 1.
Figure 6:
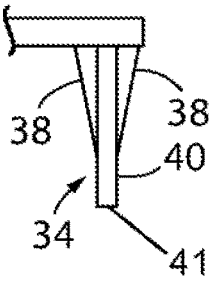
FIG. 6 is a partially broken-away side elevational view of a post of the insert of FIG. 4.
Figure 7:
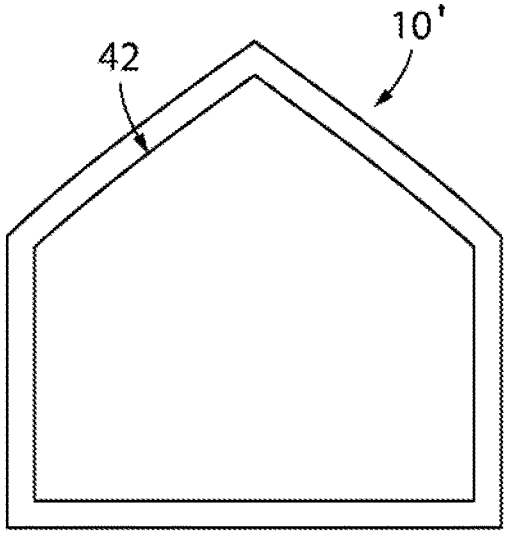
FIG. 7 is a top plan view of a home plate constructed according to an exemplary embodiment the invention.
Figure 8:
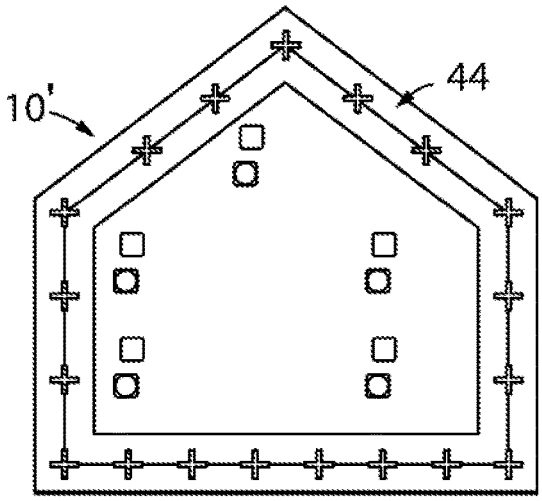
FIG. 8 is a bottom plan view of the plate of FIG. 7.
Figure 9:
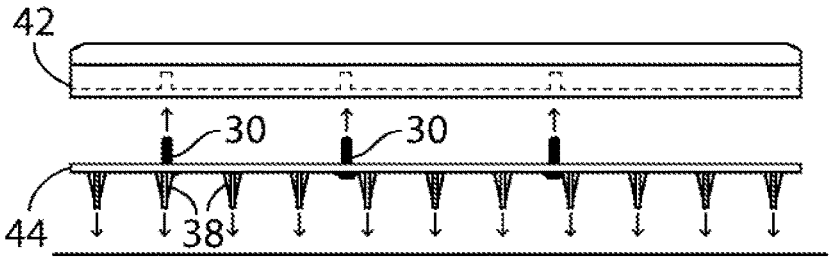
FIG. 9 is an exploded side elevational view of the plate of FIG. 7.
Figure 10:
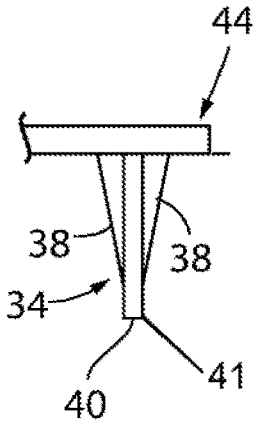
FIG. 10 is a partially broken-away side elevational view of a post of the insert of FIG. 9.
Figure 11:
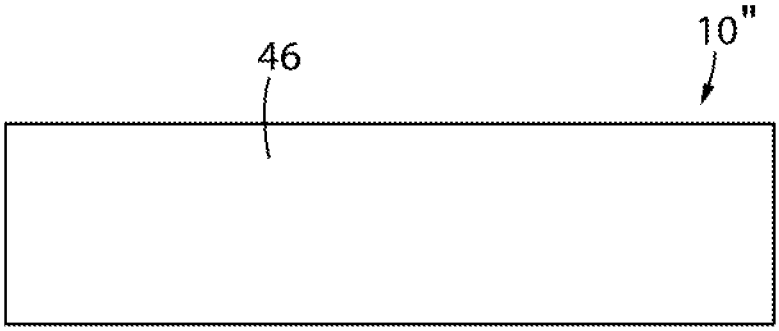
FIG. 11 is a top plan view of a pitcher's rubber constructed according to an exemplary embodiment the invention.
Figure 12:
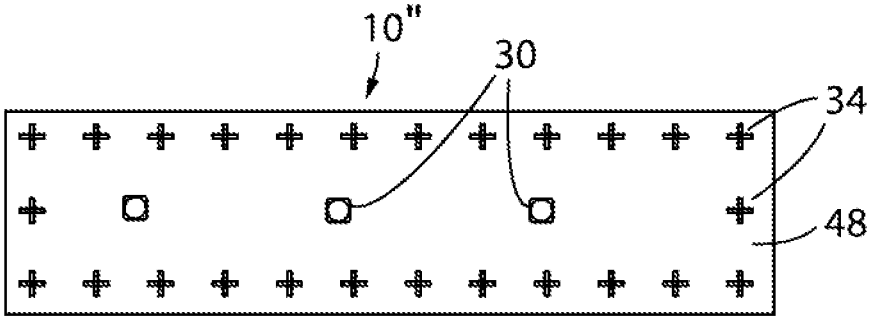
FIG. 12 is a bottom plan view of the rubber of FIG. 11.
Figure 13:
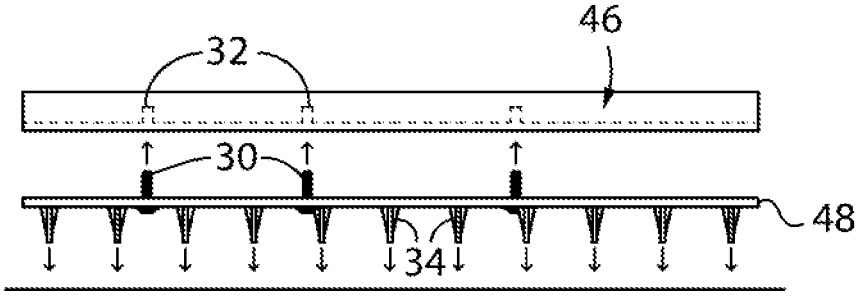
FIG. 13 is an exploded side elevational view of the rubber of FIG. 11.
Figure 14:
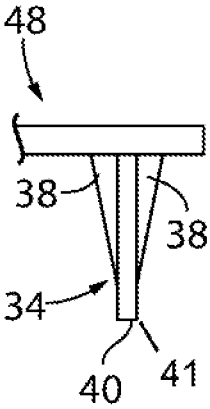
FIG. 14 is a partially broken-away side elevational view of a post of the insert of FIG. 13.

Referring now to FIGS. 1 and 2, the reference numeral 10 generally identifies an illustrated exemplary embodiment of a base, plate, pitching rubber or similar device constructed according to the present disclosure. The base 10 includes an insert 12 having a body 13 formed of any suitable material, such as a metal, hard plastic or rubber, and a top structure 14 engaged with the insert 12 to form the base 10. For example, the top structure 14 for the base 10 can include a rubber outer shell, an interior foam pad and a rigid, i.e., metal, bottom plate (not shown) or can be formed entirely of a rubber material. The top structure 14 is formed in any suitable manner and to take any suitable form such as the form of a base, plate or pitching rubber, among others, and of any suitable material to function as necessary in playing a game, such as baseball or softball, for example.

Looking now at FIGS. 2-6, in the illustrated exemplary embodiment, insert 12 is positioned on or against a bottom surface 16 of the top structure 14 and is formed of a generally planar body 18 that generally corresponds in shape to the shape of the top base structure 14. In alternative embodiment, the insert 12 has any desired shape along with a perimeter 20 that is smaller than the perimeter 22 of the top base structure 14 in order to enable the insert 12 to be completely covered by the top base structure 14.

In another exemplary illustrated embodiment, the top base structure 14 includes a recess 26 extending inwardly from the bottom surface 16 and within which at least a portion of the insert 12 can be received. The top base structure 14 can also include ground-engaging stabilizing structures or bars 28 disposed around the recess 26.

The insert 12 is positionable within the recess 26, and optionally has a shape directly corresponding to the shape of the recess 26. The insert 12 includes a number of studs 30 optionally formed either integrally with or separately from the body 18, such as by forming the studs 30 as screws (not shown) inserted through corresponding openings 29 in the body of the insert 12 that extend upwardly from an upper surface 31 of the body 18 for insertion and optionally threaded engagement within corresponding bores 32 located in the bottom surface 16 of the top base structure 14.

Opposite the studs 30, the insert 12 includes a number of posts 34 extending outwardly from a lower surface 33 of the body 18. The posts 34 are optionally either integrally formed with or formed separately from and securely attached to the body 18. The posts/spikes 34 are positioned over the entire surface of the body 18 and function to engage the natural or artificial ground or turf 36 on which the insert 12 is placed in order to securely hold the insert 12 in the desired location on and/or in the ground 36. To facilitate the secure engagement of the posts/spikes 34 with the ground 36, in the illustrated exemplary embodiment each post 34 is formed with a number of angled fins 38 disposed around a central member 40, which can optionally include or terminate in a pointed tip 41 opposite the body 18 to ease the insertion of the posts 34 into the ground 36, but that also securely hold the insert 12 on the ground 36 against lateral forces directed onto the insert 12. In one exemplary embodiment, each post 34 has a relatively short overall length, e.g., 2.54 cm or one inch (1") or less, with a one centimeter (1 cm) or 0.394 in width at their widest point, such that the engagement of the posts 34 with the ground 36 does not require significant effort, but the arrangement of the posts 34 across the entire body 18 of the insert 12 provides a more than sufficient attachment between the insert 12 and the ground 36 to prevent disengagement for the insert 12 from the ground 36 from lateral forces when in use. However, the configuration of the posts 34 enables the insert 12 to be readily moved in a vertical direction relative to the ground 36, such that the insert 12 and/or the individual posts/spikes 34 on the insert 12 can be easily removed when desired after use. Further, the attachment of the insert 12 to the top structure 14 using the studs or screws 30 enables the insert 12 to be removed from the top structure 14 and replaced if one or more of the posts/spikes 34 has become damaged during use of the insert 12.

In operation, the insert 12 is initially positioned against the bottom surface 16 of the top structure 14, optionally within the recess 26, if present to align the bores 32 in the bottom surface 16 with the openings 29 in the insert 12. Once aligned, the studs 30 are inserted through the openings 29 into the bores 32 and secured therein in order to hold the top base structure 14 to the insert 12. In this configuration, posts 34 on the insert 12 are positioned against and driven into the ground 36 to securely engage the insert 12 and top structure 14 with the ground 36. After use, the top base structure 14 and the insert 12 can be vertically moved relative to the ground 36 to disengage the posts 34 from the ground 36. Further, the small size of the posts 34 leave relatively minimal damage to the ground or turf 36 on which the insert 12 is placed, greatly reducing the effects of use of the base 10 on the ground 36.

Referring to the additional exemplary embodiment of FIGS. 7-10, the top base structure 14 is formed or configured as a home plate 42 that is placed on an insert 44 having a shape and perimeter closely similar or identical to that of the home plate 42 and with a modified placement of the studs 30 and bores 32 thereon. The insert 44 is formed similarly to insert 12, while the home plate 42 has a more rigid structure than that of top structure for the base 10, corresponding to the construction of a conventional home plate.

Referring to the further exemplary embodiment of FIGS. 11-14, the top base structure 14 is formed as a pitcher's rubber 46 that is placed on an insert 48 having a shape and perimeter closely similar or identical to that of the pitchers pitcher's rubber 46 and with a modified placement of the studs 30 and bores 32 thereon. The insert 48 is formed similarly to insert 12, while the pitchers pitcher's rubber 46 has a more rigid structure than that of top structure for the base 10, corresponding to the construction of a conventional pitcher's rubber.

Various other embodiments of the present invention are contemplated as being within the scope of the filed claims particularly pointing out and distinctly claiming the subject matter regarded as the invention.

We claim:

1. A base comprising:

a) a top structure including a recess and a number of bores extending from the recess into the top structure; and b) an insert including a body having an upper surface insertable into the recess and including a number of studs removably insertable within the bores in the top structure and a lower surface including a number of posts thereon adapted to engage a ground surface on which the insert is positioned, wherein the studs are directly engaged with the bores.

2. The base of claim 1 wherein the posts are spaced about the lower surface of the insert.

3. The base of claim 1 where the posts are formed integrally with the insert.

4. The base of claim 1 wherein the posts each include a tip opposite the insert.

5. The base of claim 1 wherein the posts each include a number of fins extending outwardly form the posts.

6. The base of claim 5 wherein the fins are angled along their length.

7. The base of claim 1 wherein the studs are slidably inserted within the bores in the top structure.

8. A method for connecting a base to a desired location on a ground, the method comprising the steps of:

a) providing a base comprising:

i) a top structure including a recess and a number of bores extending from the recess into the top structure; and ii) an insert including a body having an upper surface including a number of studs removably engageable within the bores, and a lower surface including a number of posts thereon;

b) engaging the bores on the top base structure with studs on the insert; and c) engaging the posts on the insert with the ground.

* * * * *